United States Patent [19]

Koontz et al.

[11] 4,118,116

[45] Oct. 3, 1978

[54] X-RAY PROCESSING SYSTEM

[75] Inventors: Paul G. Koontz, Granada Hills; Richard L. Wright; Robert J. Patterson, both of Canoga Park, all of Calif.

[73] Assignee: Hipoint Research, Inc., Van Nuys, Calif.

[21] Appl. No.: 808,033

[22] Filed: Jun. 20, 1977

[51] Int. Cl.[2] ..... G03G 15/00

[52] U.S. Cl. ..... 355/3 R; 198/626; 250/315 R; 250/468; 355/16

[58] Field of Search ..... 355/3 R, 3 DD, 16; 354/322; 250/468, 471, 315 R; 118/654; 96/1 R; 198/626

[56] References Cited

U.S. PATENT DOCUMENTS

| | | | |
|---|---|---|---|
| 3,650,620 | 3/1972 | Hoyt | 355/16 X |
| 3,672,760 | 6/1972 | Lunning et al. | 250/315 R |
| 3,920,991 | 11/1975 | Baker et al. | 250/468 X |
| 4,038,943 | 8/1977 | Nelson et al. | 118/654 X |

*Primary Examiner*—Richard L. Moses
*Attorney, Agent, or Firm*—Robert M. Hessin

[57] ABSTRACT

A system for xerographic processing of a radiation responsive photoreceptor plate to produce an output printout of radiated subject matter, and thereafter to neutralize and store the photoreceptor plate in readiness for a next successive X-ray irradiation. The system utilizes a photoreceptor plate of charge orientable substance of sufficient strength to withstand expected usage; the system then includes a series of processing stations within a suitable protective enclosure wherein a positive engagement belt drive carries the photoreceptor plate through a processing conveyance for application of xerographic toner, image printout to paper or film, plate relaxation, plate neutralization and, finally, plate storage under controlled heat in readiness for next successive imaging.

19 Claims, 5 Drawing Figures

X-RAY PROCESSING SYSTEM

BACKGROUND OF THE INVENTION

1. Field of the Invention

The present invention relates to xerographic radiography and, more particularly, but not by way of limitation, it relates to an improved X-ray radiation responsive plate and image recording system.

2. Description of the Prior Art

While the prior art records several types of xerographic apparatus for use with X-ray irradiated imaging plates, such past developments have usually been directed to apparatus specifics rather than to an overall processing system which enables rapid image reproduction and subsequent reuse of the photoreceptor plate for a next X-ray irradiation of selected subject matter. However, one earlier form of processing system is the subject of U.S. Pat. No. 3,650,620 as issued on Mar. 21, 1972 in the name of Hoyt.

SUMMARY OF THE INVENTION

The present invention relates to a unitary X-ray irradiation system wherein a cassette-contained photoreceptor plate is irradiated and then placed in an apparatus for image development, printout and re-preparation of the photoreceptor plate for subsequent cassette insertion and output for irradiation usage. The apparatus contains a positive displacement conveyor under control of a microprocessor unit which receives the photoreceptor plate for controlled movement along plural processing stations with resultant printout of the image subject matter and subsequent neutralization and storage of the photoreceptor plate for its next irradiation usage.

Therefore, it is an object of the present invention to provide a xerographic X-ray system that provides rapid image printout of the irradiated subject matter and preparation of the photoreceptor plate for next X-ray imaging operation.

It is also an object of the invention to provide xerographic X-ray apparatus which prints out an X-ray picture of improved quality.

It is still further an object of the present invention to provide apparatus for printing an X-ray picture of selected subject matter but requiring reduced X-ray irradiation per unit area of the subject.

Finally, it is an object of the invention to provide X-ray imaging apparatus which is unitarily contained and may be placed in convenient location to X-ray irradiation apparatus, and which obviates some of the past inconveniences associated with X-ray film processing systems.

Other objects and advantages of the invention will be evident from the following detailed description when read in conjunction with the accompanying drawings which illustrate the invention.

DETAILED DESCRIPTION OF THE PREFERRED EMBODIMENT

Figure 1:
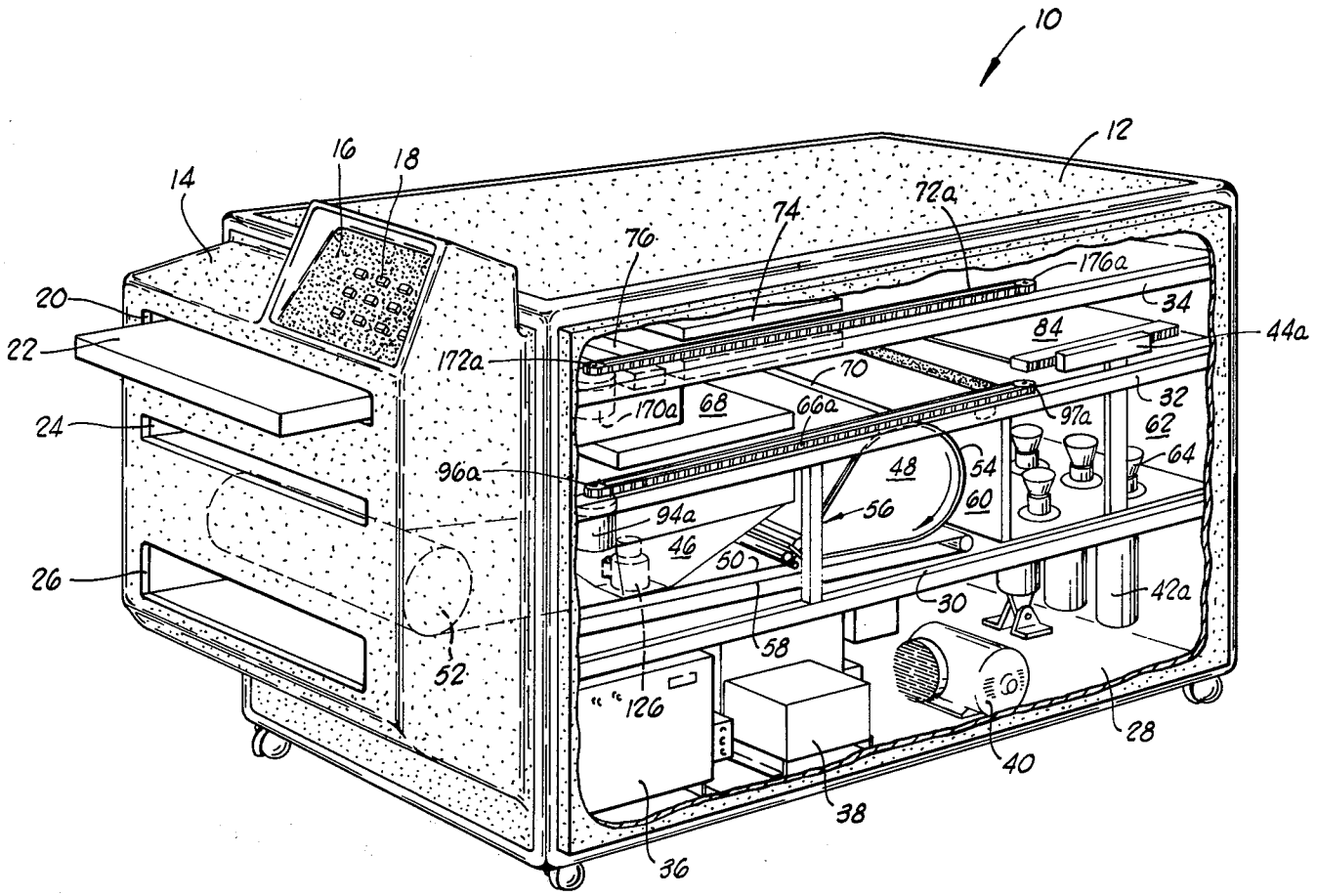
FIG. 1 is a perspective view with side panels shown cutaway and illustrating the apparatus of the present invention.

As shown in FIG. 1, the X-ray processing apparatus 10 is a unitary structure consisting of an interior frame within an outer housing 12 including side, rear and top panels, and constructed of suitable plastic that provides the necessary structural strength. A front panel 14 includes an operator's control panel 16 which includes a plurality of alpha-numeric digital control buttons 18 as utilized in conjunction with microprocessor circuitry to control timing and coordination of the processing function. The front panel includes a plurality of access slots, a READY slot 20 wherein a plate prepared for irradiation is available in a cassette 20; in addition, there is an image processing slot 24 and a film tray slot 26. Image processing slot 24 receives an irradiated cassette due for image processing, and film tray slot 26 provides output for the finished X-ray image printouts.

The interior of apparatus 10 is a generally three level structure as defined by a rigid frame, e.g., a metal structure, and comprising a bottom panel 28, first panel 30, second panel 32 and fourth panel 34, all of which are supported in generally parallel array by corner structure assemblies such as corner-located connecting tubes and threaded securing members (not shown). The lower panel 28 serves to support the power and operating components of the apparatus and includes a housing 36 for electrostatic and general power supply enclosure as well as a chassis 38 for microprocessing control circuitry. An air compressor 40 is located on panel 28 and serves to provide the requisite pneumatic power for operation of various components, as will be further described. Air-operated cylinders **42*a* and 42*b* are supported beneath panel 30 and these function to control the level of elevators 44*a* and 44*b***, also to be described.

Between second panel 30 and third panel 32 are a toner section 46 and an image transfer section 48 wherein film or paper from a storage roll 50 at a front access location is led rearward and around a generally arcuate guide roll 54 for return to a paper cutting station 56 whereupon the properly imaged and developed printout is cut and dropped onto a conveyor 58 for delivery to the film tray 26. A vertical panel 60 rearward of print section 48 provides light isolation from a rearward plate relaxation section 62 which includes a plurality of incandescent lamps 64 therein.

An irradiated plate entered within the cassette at image processing slot 24 proceeds along the third panel 32 by means of positive displacement conveyor belts **66*a* and 66*b* (shown more particularly in FIG. 4), and in this manner the imaged plate is moved along the various processing stations as driven by stepping motors in proper sequence and coordination. After the imaged plate has been moved beneath a plate backing block 68, and thence to a printout roll position 70, it is moved to elevator 44, shown holding a plate 84, and raised upward to the fourth panel 34 for re-entry in the reverse direction on return conveyor belts 72*a* and 72*b*. The structure of conveyor belts 72*a* and 72*b* are identical, except mirror image, and serve to provide positive displacement of the relaxed image plate back beneath a plate warmer 74** which maintains the relaxed photoreceptor plate in a stored condition awaiting next usage.

Then, upon demand, the plate is moved forward across the charging SCOROTRON 76 for light-tight deposit within cassette 22 whereupon it is ready for irradiation imaging usage on next selected subject matter.

Figure 2:
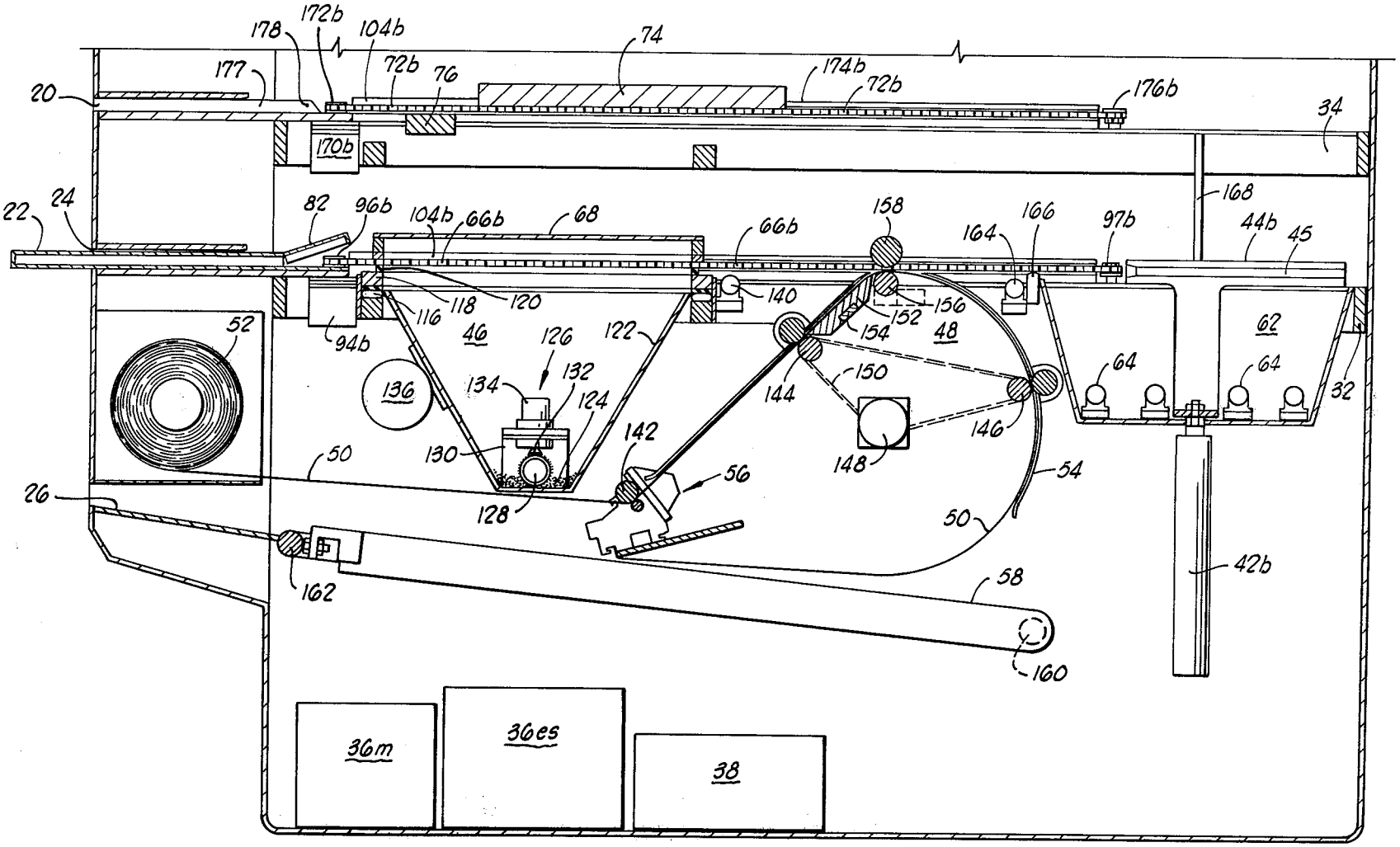
FIG. 2 is a vertical cross-section lengthwise of the processing apparatus shown in partial schematic form.
Figure 3:
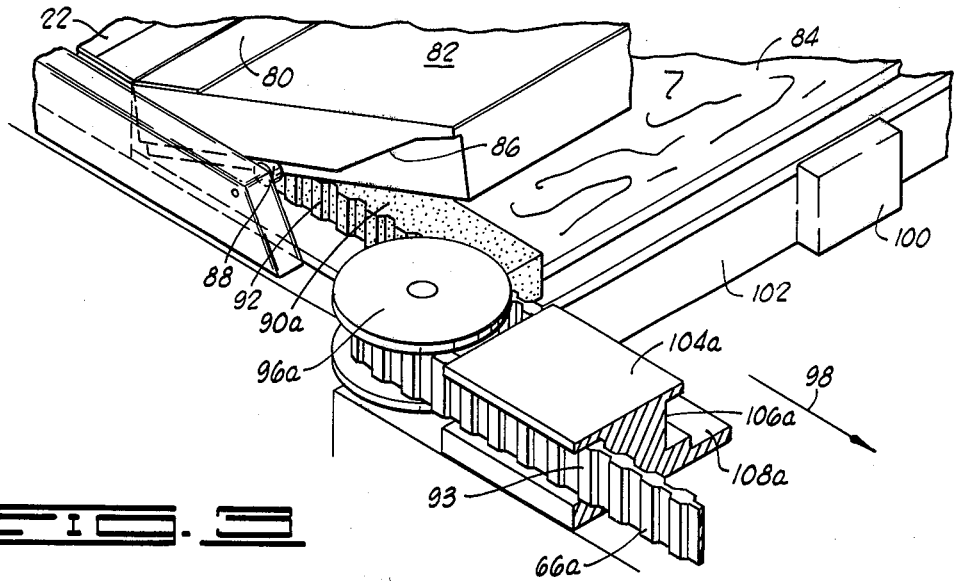
FIG. 3 is an enlarged perspective view detailing a portion of the conveyor belt drive, cassette and plate of the present invention.
Figure 5:
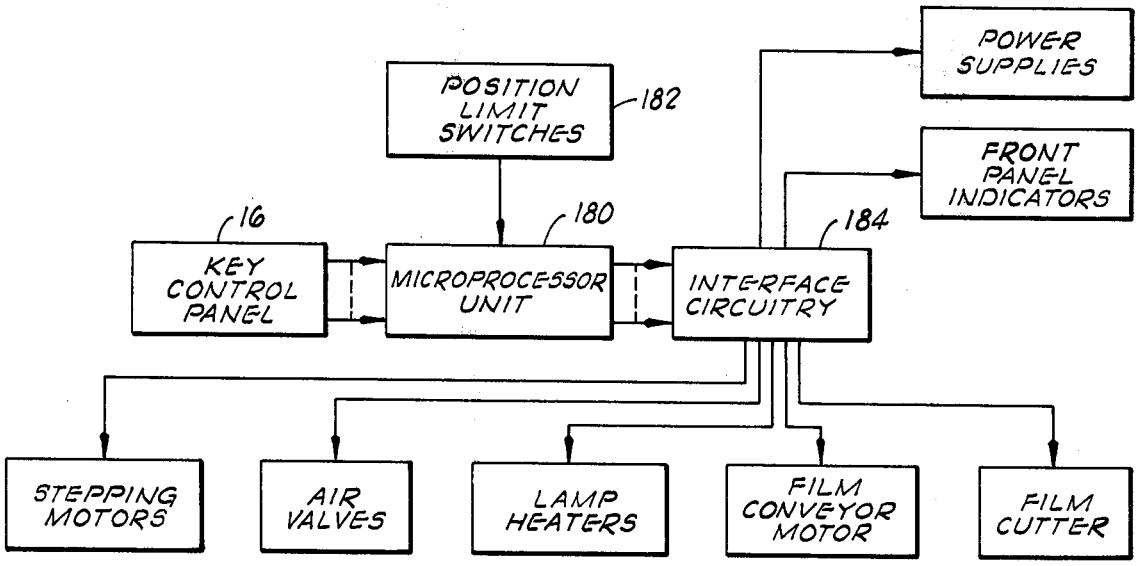
FIG. 5 is a block diagram of the control functions utilized in the apparatus.

FIG. 2 illustrates the plate tracking and processing and is shown with a cassette 22 in the image process slot 24 as would begin the image development operation. As shown in FIG. 3, the cassette 22 includes a hinge plate 80 as connected to a forward cassette flap 82 which is capable of being raised upward to expose the plate 84 upon full insertion of the cassette 22. A cam way 86 formed on opposite sides of forward cassette flap 82 coacts with cam rollers 88 on opposite sides thereof during insertion of the cassette 22 to enable engagement of plate 84 with the conveyor.

The cassette material, at least the side of cassette 22 through which the X-ray irradiation passes to expose the photoreceptor, is constructed of carbon filament in an epoxy matrix laid up in finite thickness, and it is then cured under heat and pressure. Construction in this manner produces a cassette member with a minimum of X-ray absorption and sufficient strength to prevent contact with the active surface of the photoreceptor plate 84 under patient load in all normal applications. The size of cassette 22 may be varied, but as constructed with dimensions of fifteen by eighteen inches, it is capable of housing a photoreceptor plate 84 approximating the conventional X-ray film area.

Referring again to FIG. 3, the plate 84 is supported on each side by suitably molded plate rails 90, one on each side, (See also FIG. 4) having vertical tooth configurations 92 molded along the outer edge thereof for mating engagement with the conveyor belts. The conveyor belts 66 and 72 are each formed to have a plurality of equi-spaced teeth 94 for positive engagement with plate rails 90. Thus, when cassette 22 is completely in place, and gripping teeth 92 are in engagement with gripping teeth 94 of oppositely disposed conveyor belts **66*a* and 66*b*, stepping motor control is begun to move the plate 84 along the processing track. Stepping motors 94*a* and 94*b* provide drive input to respective track pulleys 96*a* and 96*b* to move plate 84 in the direction indicated by arrow 98. A stop 100 on cross frame member 102 serves to contact the underside of cassette 22 for retention in a limit position as plate 84** moves out into the processing sequence.

Figure 4:
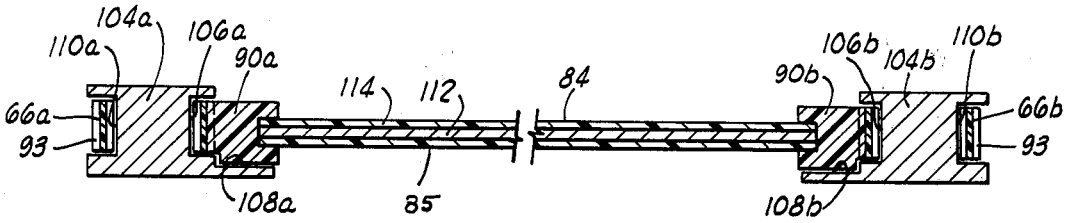
FIG. 4 is a cross-section of a conveyor and plate as utilized in the present invention.

As shown in FIGS. 2, 3 and 4, each of the conveyor belts **66*a* and 66*b* are moved along the tracking route as controlled by a respective guide rail 104*a* and 104*b*. Each of guide rails 104*a* and 104*b* are unitarily formed of low friction material, e.g., NYLON, with interior configurations forming a conveyor belt guide 106*a* and 106*b*, and a further inset plate rail guide 108*a* and 108*b* to accommodate plate rails 98*a* and 98*b* (See FIG. 4). Outer belt guides 110*a* and 110*b* then accommodate return traverse of the conveyor belts 66**.

Referring again to FIG. 3, the photoreceptor plate 84 is constructed so that it accepts an X-ray image of diagnostic quality at low patient exposure to radiation. The plate 84 (FIG. 4) is constructed of a photoreceptor element 112 and is supported and protected by a substrate 114 (lower substrate 85) of suitable strength and thickness. In present practice, the substrates 114 and 85 are made up of multilayer carbon filaments cured under high heat and pressure in an epoxy matrix, and the carbon filament material serves to produce a plate that is rugged, lightweight, electrically conductive and transparent to X-rays so as to minimize X-ray scatter. This is desirable since X-ray scatter increases patient exposure and reduces image quality. The use of carbon material for the substrates 114 and 85 also reduce the physical damage that can take place at the interface with the photoreceptor element 112 due to any differential in thermal expansion. It is contemplated that some applications will only use a lower substrate 85 and photoreceptor 112, but in either case a known form of protective coating is applied over all surfaces to prevent surface damage during image transfer and at the plate cleaning station, as well as to protect from moisture and oxidation.

The photoreceptor 112 may be such as a high purity selenium that has been modified in known manner by addition of elements or impurities which produce the electrical characteristics necessary to hold an electric charge, to be imaged by X-rays, and to hold that image for sufficient time for transfer to the film media. The added impurities also increase the ability to absorb X-ray radiation and, in turn, this increases the sensitivity of the photoreceptor to enable reduction of the required X-ray exposure on the patient to produce a suitable image. The photoreceptor 112 is a highly layered structure comprising alternate P type, neutral type and N type materials. In present practice, the selenium substrate or photoreceptor 112 is modified by deposition in a vacuum by the method referred to as sputtering. This may be done with high purity selenium as used in a magnitron-type cathode wherein the sputtering phenomenon is produced by back filling a high vacuum with an inert gas sufficient to achieve a slow discharge. A part of the inert gas is replaced with the gaseous form of the element used to modify the selenium and thereby to produce the particular electrical characteristics desired in a particular level of the photosensitive coating or sputtered material. The proportions of the additives may be highly controlled as well as can the sequence in which the additives are released into the vacuum chamber. With addition of a sequencing device or microprocessor of suitable design, a photoreceptor of any layer pattern and of any thickness can be automatically processed through a fully automatic vacuum depositing sputtering system. Use of a system such as this eliminates the need for doped selenium or the processing of selenium through a doping process.

Referring again to FIG. 2, an exposed plate 84 as inserted within cassette 22 at image processing slot 24 is engaged with mating conveyor belts **66*a* and 66*b* and, under power of stepping motors 94*a* and 94*b*, the plate 84 is moved beneath the back up plate 68 of toner station 46. When plate 84 is properly positioned, air valve actuation expands rubber enclosure 116 to raise a sealing frame 118 and plate seal 120 upward beneath the outer confines of photoreceptor plate 84. This seals the exposed expanse of plate 84 for isolation relative to the toner chamber 122, which may be of generally pyramidal shape, containing a volume of dry toner 124 therein. It is desirable that the toner 124 be applied in almost totally divided particles, evenly distributed over the photoreceptor 84 and each having the requisite electrical charge of correct polarity. This is accomplished by means of a transvector unit or air flow amplifier 126 which picks up the toner 124 from the sump and disperses the toner in a cloud across the photoreceptor plate 84. The transvector unit 126 utilizes a rotating brush 128 supported within toner 124 by means of a suitable frame 130, and brush 128 disperses toner 124** through a pickup tube 132 upward through a vortex air distributor 134.

A transvector unit 126 such as specified produces the toner cloud in larger volume but with less velocity at the surface of plate 84 thus eliminating the need for additional air flow to disperse toner in the proper cloud form. A vibrator 136 provides agitation to continually redistribute toner into the sump area. The transvector unit 126 does not depend upon air pressure or air flow to control the amount of toner placed in the toner cloud, but air flow is controlled in ordder to produce the desired cloud velocity and dispersion. Toner volume is controlled by the speed in RPM of the motor driving brush 128 and vortex air unit 134. Thus, motor speed can be adjusted from the front panel in order to produce darker or lighter images to suit the operator radiologist.

After completion of the toner stage, the conveyor track 66 is actuated to pass the photoreceptor plate 84 with developed image over a transverse incandescent lamp 140, and this serves to reduce the electrical charge of the photoreceptor plate 84 to nearly zero volts. This enables transfer of the maximum amount of toner from the plate 84 to the reproduction medium. With reduction to zero volts, the static charge of the toner particles is still sufficient to keep the toner in place on the photoreceptor plate 84.

Conveyor belt 66 then moves photoreceptor plate 84 through image transfer station 48 which utilizes a dimensionally stable medium such as polyester film or paper that has a thin coating of a low temperature melting plastic. This reproduction medium is a commercially available material and is supplied in volume on a forward panel roll 52 whereupon the medium 50 is led back through the image transfer stage 48. A cutter and drive device 56 of conventional form provides input drive to medium 50 and is motor controlled in synchronism to actuate roller drive 142. Movement of medium 50 proceeds up and around arcuate guide device 54 under the synchronized control of roller pairs 144 and 146 driven by film transfer stepping motor 148 via drive belt 150. The medium 50, the selected film or paper, is passed from drive rollers 144 over an aluminum plate 152 having a heating element 154, and plate 152 is maintained at heat sufficient to soften the low melt plastic coating on medium 50. Thereafter, medium 50 is moved into roller contact with the underside of synchronously moving photoreceptor plate 84 between print rollers 156 and 158. Roller 158 is an aluminum cooling roller, and when the reproduction medium 50 comes in contact with the photoconductor or underside of receptor plate 84, the toner image is trapped in the soft plastic coating of medium 50. As the coating cools and hardens on contact the film is removed from the photoreceptor to continue its traverse through rollers 146 for metered film cutting and deposit on conveyor 58 which delivers the finished print to film tray 26. Conveyor 58 is a conventional form of conveyor as driven between rollers 160 and 162 to carry the X-ray image printout for access at film tray 26.

As the photoreceptor plate 84 is driven away from print rollers 156 and 158, it is again driven across an incandescent lamp 164 and vacuum nozzle 166 for further charge neutralization and removal of remaining toner. Thereafter, the photoreceptor plate 84 moves into the elevator rails 84 and over the relaxation station 64 wherein plural incandescent lamps 64 normalize the plate to maximum sensitivity without thermal stressing of the photoreceptor element 112. Under programmed control of plate conveyance, the elevator cylinders 42*a* and 42*b* are actuated to raise the respective elevators 44*a* and 44*b* and photoreceptor plate 84 upward for engagement with opposing conveyor belts 72*a* and 72*b*. Each of elevators 44*a* and 44*b* include an interior horizontal groove 45 for receiving plate rails 90*a* and 90*b* therein for securing positioning. The upper level conveyor belts 72*a* and 72*b* are of identical construction to belts 66*a* and 66*b* in that each is driven by means of a respective stepping motor 170 and 170*b* between drive pulleys 172*a* and 172*b* along belt guides 174*a* and 174*b* with return about pulleys 176*a* and 176*b*, respectively. When photoreceptor plate 84 is engaged by belts 72, controlled movement brings the plate forward and beneath a plate warmer 74 which includes a heated block of sufficient volume to be able to bring the plate 84 temperature to match the temperature stabilization block 74 in just a few seconds. This is done by bringing the plate into intimate contact with the stabilization block 74 and holding plate 84 in this position until the photoreceptor plate 84 is needed for next imaging.

When the stored plate 84 is needed for next imaging, initiation from control panel 16 energizes conveyor drive motors 170 to move the plate 84 out of storage and stabilization block 74 across SCOROTRON 76 which serves to place requisite electrostatic charge on the photoreceptor element 112 as it passes thereover. With additional movement, photoreceptor plate 84 is moved past drive pulleys 172 and into an awaiting cassette 22 which has been inserted in plate ready slot 20. Camming structure, including side rail 177 and cam roller 178, similar to that shown in FIG. 3, is also included within plate ready slot 20 to insure that the cassette forward flap 82 is open and able to receive the photoreceptor plate 84 as it is driven therein. Upon completion of the drive limits, the plate ready cassette may be removed from slot 20 with cassette flap 82 dropping into light closure position, and the cassette and plate are then ready for X-ray imaging exposure.

Actual control and synchronization constitutes no part of the present invention; however, the apparatus utilizes those forms of pneumatic power, synchronous motor movement and programmed control sequencing as is well-known in xerographic reproduction apparatus. Thus, the equipment utilizes a central microprocessor unit 180 which is preprogrammed to accept operator input from key control panel 116 as well as operational inputs from position limit switches 182. Output from microprocessor unit 180 is then applied through interface circuitry 184 to provide the controlled distribution function that energizes synchronously the several stepping motors, air valves, lamp heaters, film conveyor motor, and film cutter.

In operation, a radiation exposed photoreceptor plate 84 is inserted at slot 24 and moved throughout the processing machine by means of double sided timing belts, belts 66 and 72, each guided in a plastic track or belt guide 104. The track system for moving plates 84 prevents the dropping of plates and provides a firm support of each plate 84 at each processing station as it insures engagement and total capture of plate 84 during movement and processing. Stepping motors 94 and 170 provide plate movement along the lower and upper conveyor tracks, respectively, and synchronized drive insures non-jamming movement at controlled speed and distance. The stepping motors 94 and 170 are of a well-known type that provides the ability to program speed changes to suit each station operation.

As the exposed plate 84 is moved within the plate backup 68, the toner enclosure 122 is pneumatically moved upward into airtight engagement beneath the photoreceptor plate. Then, in timed relationship, the vortex air unit 134 is energized to provide a cloud of charged toner particles across the underside of the photoreceptor plate 84. The toner 124 is applied in evenly divided particles, evenly distributed over the photoreceptor with electrical charge of correct polarity, and any toner not adhering to the photoreceptor is dropped down for redeposit in the bottom of the toner sump.

The photoreceptor plate 84 is then released from under the backup plate 68 whereupon the conveyor belts **66*a* and 66*b* move the plate across the incandescent lamp 40 to the image transfer stage. Image transfer takes place at bottom roller 156 and cooling roller 158. Printout is on paper or film stored on roll 52 and which is metered through roller 142 and drive rollers 144 to a heating block 152 which melts the plastic coating; thereafter, the reproducing medium 50 and the photoreceptor plate 84 are moved through the print rollers 156 and 158 in precise synchronism with the finished reproduction on medium 50 continuing through rollers 146 to eventual cutting and deposit on conveyor 58 for delivery to the film tray 26**.

Yet another incandescent lamp array 164 and vacuum nozzle 166 serve to clean any remaining toner from the underside of plate 84 whereupon it is further conducted by conveyors **66*a* and 66*b* for retention in grooves 45 of elevator frames 44*a* and 44*b*. Timed actuation of air pressure to cylinders 42*a* and 42*b* then drive the elevators and plate 84 upward such that the toothed side rails 90*a* and 90*b* are engaged in the upper conveyor belt 72*a* and 72*b*. Commencement of forward motion then moves the plate 84 within the storage and temperature stabilization station beneath heated block 74. The photoreceptor plate 84 may then remain within heated block 74 until called upon for a next successive irradiation usage. At this time, properly programmed energization of conveyor drive motors 170*a* and 170*b* serves to move the photoreceptor plate 84 across the SCOROTRON 76 for charging and eventual deposit within a cassette 22 as has been inserted within the plate ready slot 20**.

The microprocessor circuitry 38, as controlled from front panel 16, utilizes an eight-bit microprocessing unit to control all electronic and mechanical functions of the system. The microprocessor itself is controlled in accordance with a specialized software program as specifically designed to operate through the necessary electronic interfacing circuits 184 to control apparatus 10.

Through programmed sequencing, the microprocessor unit accepts digital information from the alphanumeric control buttons 18 prior to and during operating cycle, and such control selects specific voltages used in photoreceptor charging, image development, patient identification printing and the like. Inputs from photoreceptor positioning components or limit switches are received by the microprocessor unit, and it then activates control circuits to turn on and off the interface components energizing stepper motor operation, air valve operation, etc. The microprocessor is also presently designed to monitor temperature of film and plate warmer, and to alert the operator as to any improper temperatures and/or heating subsystem malfunctions.

Changes may be made in the combination and arrangement of elements as heretofore set forth in the specification and shown in the drawings; it being understood that changes may be made in the embodiments disclosed without departing from the spirit and scope of the invention as defined in the following claims.

What is claimed is:

1. A system for xeroradiographic processing of an irradiated plate carrying a latent image, comprising:

means receiving said plate for controlled displacement along a predetermined path, said means including first and second parallel conveyor belts having equi-spaced interlocking configurations for seizure of said plate;

means operative at a first position along said path to disperse charged toner particles into contact with said plate;

means supplying a print receiving medium;

means operative at a second position along said path to bring said medium into contact with said plate carrying said toner particles and to separate said medium bearing the image; and means operative at a third position along said path to uniformly heat said plate and maintain the plate at temperature stabilization until such time as the plate is re-used to form a latent image in response to irradiation, said means including third and fourth parallel conveyor belts having equi-spaced interlocking configurations for seizure of said plate.

2. A system as set forth in claim 1 which is further characterized to include:

elevator means operative to receive said plate from said first and second conveyor belts and move said plate for reception by said third and fourth conveyor belts.

3. A system as set forth in claim 1 which is further characterized in that:

said plate consists of a photoreceptor plate of rectangular shape having first and second plate rails disposed on opposite sides and each having outwardly oriented configurations for interlock with said conveyor belt configurations.

4. A system as set forth in claim 3 wherein said photoreceptor plate comprises:

a first plate of photoreceptor material; and an underlying protective substrate that contributes rigidity yet is electrically conductive and transparent to said irradiation.

5. A system as set forth in claim 4 wherein said photoreceptor further comprises:

a coating of protective material overlying said first plate that is an electrical non-conductor and transparent to X-ray irradiation.

6. A system as set forth in claim 1 which further includes:

means operative between said second and third positions to expose said plate to incandescent light and heat to normalize said plate.

7. A system as set forth in claim 1 wherein said means operative at said first position comprises:

enclosure means having a generally rectangular upper opening and containing said toner particles;

means for sealingly engaging said enclosure means to said plate; and means operative within said enclosure means for evenly dispersing said toner particles across said plate.

8. A system as set forth in claim 1 wherein said means operative at a second position comprises:

heating means placed in contact with said print receiving medium to condition said medium for toner particle acceptance and retention; and roller means receiving said plate with toner particles and the heat conditioned medium in compressed juxtaposition therethrough at a controlled rate, whereby the toner in image representation is transferred to said receiving medium.

9. A system as set forth in claim 2 which is further characterized in that:

said plate elevator means receives said plate after said second position for delivery to a second path level; and said third and fourth parallel conveyor belts at said second path level move said plate to the third position.

10. A system as set forth in claim 2 which is further characterized in that:

said first and second conveyor belts convey said plate in a first direction and said third and fourth conveyor belts return said plate in the opposite direction.

11. A system as set forth in claim 1 which is further characterized to include:

means receiving said plate thereover after movement from said third position along said path to place a uniform electrical charge on said plate prior to irradiation re-use.

12. A system as set forth in claim 3 which is further characterized to include:

cassette means of generally rectangular shape for receiving said plate in light-tight enclosure, said cassette means having an opening flap on one end that is opened to engage said first and second plate rails with said first and second conveyor belts.

13. A system as set forth in claim 12 which further includes:

a camming surface formed on said cassette means opening flap; and cam means positioned to be contacted by said camming surface upon movement of said cassette means to said means receiving said plate.

14. A system as set forth in claim 12 which is further characterized to include:

charging means receiving said plate thereacross after movement from said third position along said path to place a uniform electrical charge on said plate; and cassette receiving means disposed adjacent said charging means to receive said cassette means in position for said third and fourth conveyor belts to move the uniformly charged plate into lighttight enclosure in the cassette means prior to removal and irradiation re-use.

15. Apparatus for xeroradiographic exposure, comprising:

photoreceptor plate means of X-ray radiation responsive material for recording latent image indication, said plate means being of generally rectangular shape;

substrate means formed in juxtaposition to underlie said photoreceptor plate means in predetermined thickness to provide structural rigidity; and first and second plate rail means each secured to an opposite side of said photoreceptor plate and substrate means, each of said plate rail means being formed along the outermost surface with a plurality of equi-spaced, toothed formations.

16. Apparatus as set forth in claim 15 which further includes:

a protective coating applied on the upper surface of said photoreceptor plate means.

17. Apparatus as set forth in claim 15 which is further characterized in that:

said substrate means is formed of carbon filament suspended within a rigidly curved epoxy material to exhibit high X-ray transparency and thus low X-ray scatter effect.

18. Apparatus as set forth in claim 15 which further comprises:

cassette means that is light-tight when closed and of generally uniformly thin, rectangular shape, and having an internal volume consonant with slidable reception therein of said photoreceptor plate means, substrate means and first and second plate rail means.

19. Apparatus as set forth in claim 18 which further includes:

a hinged flap panel disposed across one end of said cassette means to movably adjust one end of said cassette means for removal and insertion of said plate means, substrate means, and plate rail means.

* * * * *